US010465945B2

(12) United States Patent
Knoeppel et al.

(10) Patent No.: US 10,465,945 B2
(45) Date of Patent: Nov. 5, 2019

(54) SYSTEM AND METHOD FOR DETERMINING AN ABNORMAL CONDITION OF A WATER HEATER

(71) Applicant: A. O. SMITH CORPORATION, Milwaukee, WI (US)

(72) Inventors: Ray Oliver Knoeppel, Hartland, WI (US); Brian Thomas Branecky, Oconomowoc, WI (US); Geoffrey J. Behr, Milwaukee, WI (US); Jacob M. Pixler, Milwaukee, WI (US)

(73) Assignee: A. O. SMITH CORPORATION, Milwaukee, WI (US)

( * ) Notice: Subject to any disclaimer, the term of this patent is extended or adjusted under 35 U.S.C. 154(b) by 16 days.

(21) Appl. No.: 15/818,221

(22) Filed: Nov. 20, 2017

(65) Prior Publication Data

US 2018/0142922 A1 May 24, 2018

Related U.S. Application Data

(60) Provisional application No. 62/424,265, filed on Nov. 18, 2016.

(51) Int. Cl.
*F24H 9/20* (2006.01)
*F24H 1/18* (2006.01)

(52) U.S. Cl.
CPC ..... *F24H 9/2035* (2013.01); *F24H 1/186* (2013.01)

(58) Field of Classification Search
CPC ..... F24H 9/2035; F24H 1/186
See application file for complete search history.

(56) References Cited

U.S. PATENT DOCUMENTS 5,504,306 A * 4/1996 Russell ..... F24H 9/2028 219/481
6,216,703 B1 * 4/2001 Manker ..... A61B 18/18 128/898
7,032,543 B1 * 4/2006 Akkala ..... F24H 1/205 122/14.2
7,221,862 B1 * 5/2007 Miller ..... F24H 9/2021 219/497
7,565,813 B2 7/2009 Pouchak
(Continued)

FOREIGN PATENT DOCUMENTS

WO 2016025257 A1 2/2016

*Primary Examiner* — Nathaniel Herzfeld
(74) *Attorney, Agent, or Firm* — Michael Best & Friedrich LLP

(57) ABSTRACT

A method of determining an abnormal condition in a water heater. The method including sensing, via a temperature sensor, a plurality of temperatures and filtering, using a first time constant, the plurality of temperatures to produce a first plurality of filtered temperatures. The method further including determining, via a controller, if at least one temperature of the first plurality of filtered temperatures crosses a first temperature threshold, and when at least one temperature of the first plurality of filtered temperatures crosses a second temperature threshold, filtering, using a second time constant, the plurality of temperatures to produce a second plurality of filtered temperatures. The method further including initiating, via the controller, a shutdown procedure when at least one temperature of the second plurality of filtered temperatures, crosses a third temperature threshold.

24 Claims, 6 Drawing Sheets

(56) References Cited

U.S. PATENT DOCUMENTS

| | | | | |
|---|---|---|---|---|
| 9,435,566 | B2 * | 9/2016 | Hill | G05D 23/19 |
| 2010/0092308 | A1 | 4/2010 | Stiles, Jr. et al. | |
| 2016/0195294 | A1 | 7/2016 | Conner et al. | |
| 2016/0356515 | A1 * | 12/2016 | Carter | G05D 23/1917 |
| 2018/0356111 | A1 * | 12/2018 | Salsbury | F24F 11/30 |

* cited by examiner

SYSTEM AND METHOD FOR DETERMINING AN ABNORMAL CONDITION OF A WATER HEATER

RELATED APPLICATIONS

The application claims priority to U.S. Provisional Patent Application 62/424,265, filed Nov. 18, 2016, the entire contents of which are hereby incorporated.

FIELD

Embodiments relate to water heater systems and methods of operating the same.

SUMMARY

Water heater systems include tank water heaters and tankless water heaters. In some embodiments, water heater systems may include a burner configured to burn a mixture of the fuel and air to create the products of combustion. In the event of an abnormal condition (for example, an overheating condition), the water heater system may shutdown. In some embodiments, an abnormal condition is detected by one or more sensors. In some embodiments, a false abnormal condition may be detected, and the water heater system shut down, although operation is normal.

To reduce the amount of false abnormal conditions, one embodiment provides a method of determining an abnormal condition in a water heater. The method including sensing, via a temperature sensor, a plurality of temperatures and filtering, using a first time constant, the plurality of temperatures to produce a first plurality of filtered temperatures. The method further including determining, via a controller, if at least one temperature of the first plurality of filtered temperatures crosses a first temperature threshold, and when at least one temperature of the first plurality of filtered temperatures crosses a second temperature threshold, filtering, using a second time constant, the plurality of temperatures to produce a second plurality of filtered temperatures. The method further including initiating, via the controller, a shutdown procedure when at least one temperature of the second plurality of filtered temperatures, crosses a third temperature threshold.

Another embodiment provides a method of determining an abnormal condition in a water heater. The method including sensing, via a temperature sensor, a plurality of temperatures and filtering, using a first time constant, the plurality of temperatures to produce a first plurality of filtered temperatures when the at least one temperature of the plurality of temperatures is above the first temperature threshold. The method further including determining, via the controller, a rate of change of a first temperature of the plurality of temperatures and a second temperature of the plurality of temperatures and determining, via the controller, if the rate of change is below a threshold. The method further including filtering, using a second time constant, the plurality of temperatures to produce a second plurality of filtered temperatures when the rate of change is below the threshold and initiating, via the controller, a shutdown procedure when at least one temperature of the second plurality of filtered temperatures, crosses a second temperature threshold.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways.

Figure 1:
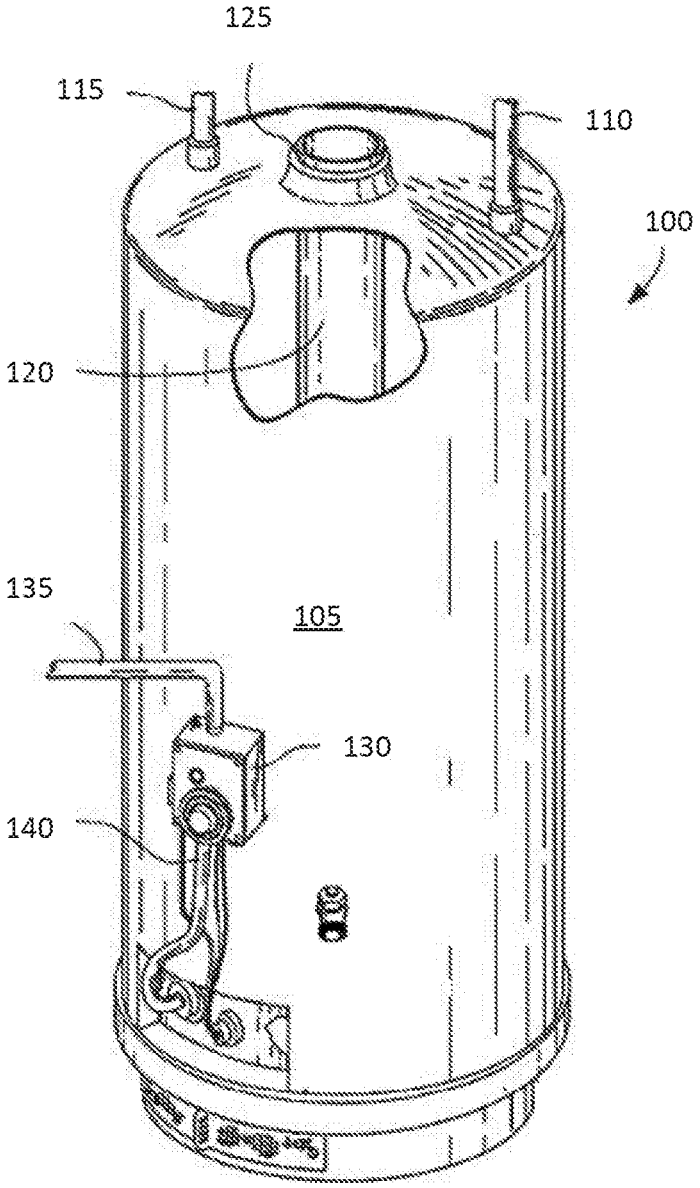
FIG. 1 is a perspective view of a water heater according to some embodiments of the application.

FIG. 1 illustrates an appliance according to some embodiments of the application. In the illustrated embodiment, the appliance is a storage-type, gas-fired water heater 100, however, in other embodiments, appliance may be a tankless water heater, an electric water heater, a hybrid gas-electric water heater, a furnace, a boiler, an air conditioner, or any other appliance configured to manipulate the temperature of a fluid.

Water heater 100 includes a water tank 105, an inlet tube 110, and an outlet tube 115. The water tank 105 stores a fluid, such as water, to be heated. The inlet tube 110 is configured to receive water into the water tank 105, while the outlet tube 115 is configured to output the heated water.

Water heater 100 further includes a flue 120 having an outlet 125. The flue 120 extends through the tank 105 such that water contained within the tank 105 surrounds the flue 120.

Water heater 100 further includes a gas valve assembly 130 mounted to the water tank 105. Fuel is provided to the gas valve assembly 130 via a gas main 135. The gas valve assembly 130 selectively controls the flow of fuel to internal components of the water heater 100 via the gas manifold 140.

Figure 2:
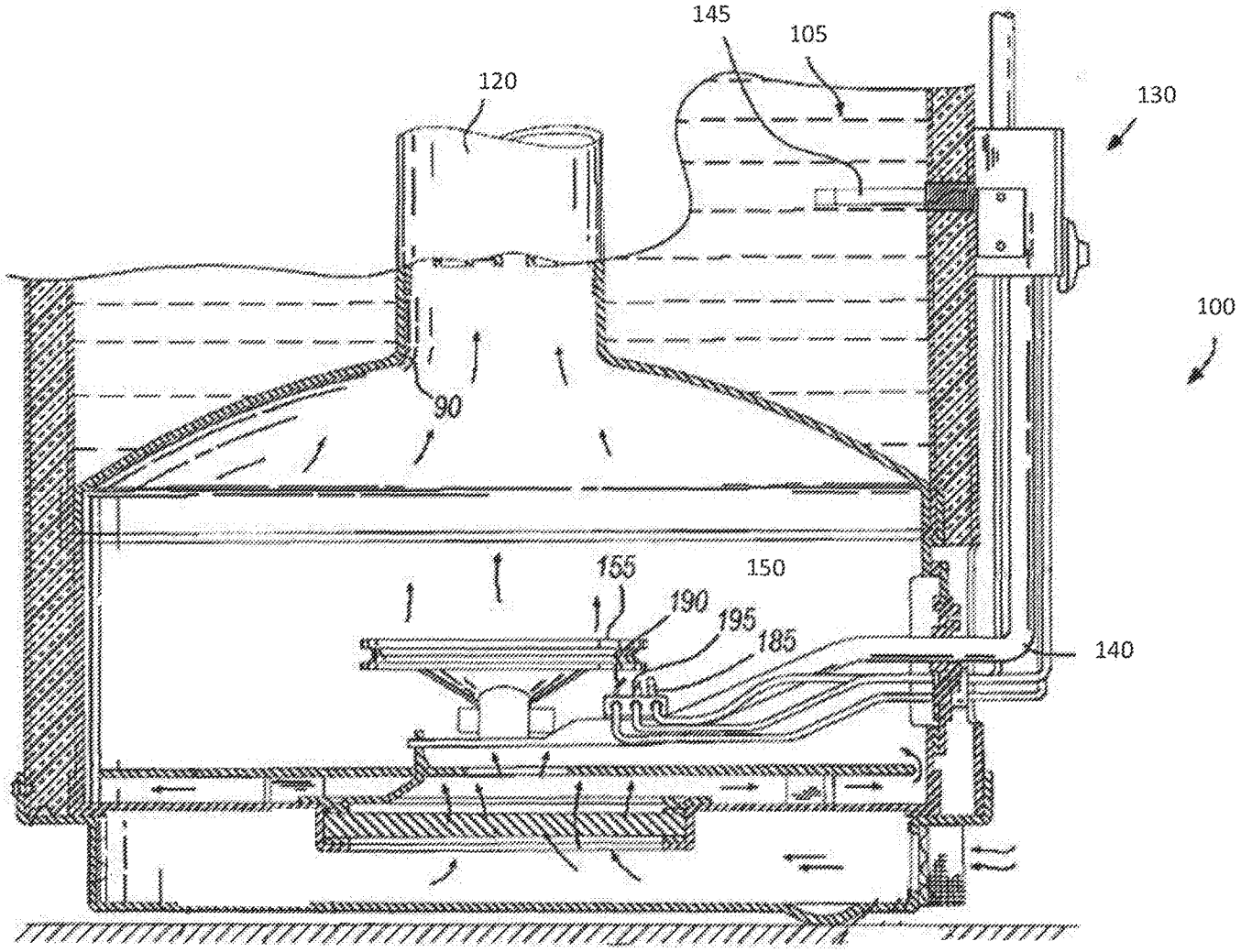
FIG. 2 is a sectional view of a bottom portion of the water heater of FIG. 1 according to some embodiments of the application.

FIG. 2 illustrates a sectional view of a bottom portion of the water heater 100 according to some embodiments. As illustrated, the water heater 100 further includes a water temperature sensor 145 configured to measure the fluid within the water tank 105. The water heater 100 further includes a combustion chamber 150. A burner 155 within the combustion chamber 150 receives fuel controlled by the gas valve assembly 130. The burner 155 burns a mixture of the fuel and air to create the products of combustion that flow up through the flue 120 to heat the fluid within the water tank 105.

Connected to the output side of the gas valve assembly 130 are the gas manifold 140, a pilot burner 185, a thermopile 190, and an igniter 195. The assembly 130 provides a flow of fuel to the pilot 185 to maintain a standing pilot burner flame. Such a construction is therefore generally referred to as a "continuous pilot ignition" system. The igniter 195 is used to initiate the flame on the pilot 185 without having to reach into the combustion chamber with a match or other manual flame source. In some embodiments, a spark is generated by the igniter 195 in response to pushing a button on the assembly 130. In other embodiments, the spark is generated by the igniter 195 in response to a control signal (for example, a control signal from the control system 200 of FIG. 3).

The gas valve assembly 130 permits fuel to flow to the burner 155 in response to a water temperature sensor (e.g., the water temperature probe 180) indicating that the water temperature in the water tank 105 has fallen below a selected temperature. When fuel flows to the burner 155, it is mixed with air and the mixture is ignited when it contacts the pilot burner flame. Once the water temperature sensor indicates that the water has reached the desired temperature, the assembly 130 shuts off fuel flow to the burner 155, and the water heater 100 is in "standby mode" until the water temperature again drops to the point where the assembly 130 should again provide fuel to the burner 155.

Figure 3:
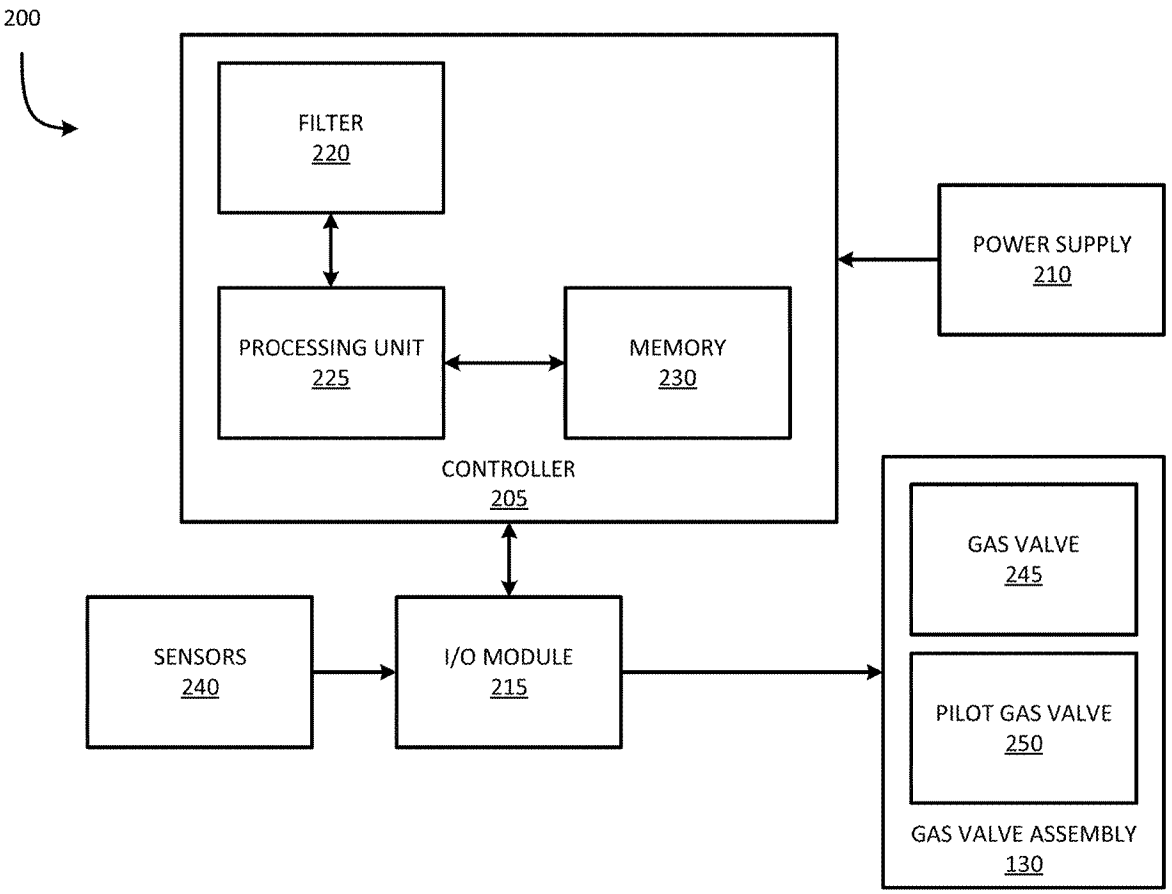
FIG. 3 is a block diagram of a control system of the water heater of FIG. 1 according to some embodiments of the application.

FIG. 3 illustrates a block diagram of a control system 200 of the water heater 100 and/or the gas valve assembly 130 according to some embodiments. The control system 200 includes a controller 205 electrically and/or communicatively coupled to, a power supply 210 and an input/output module 215. The controller 205 includes a plurality of electrical and electronic components that provide power, operational control, and protection to the components and modules within the controller 205 and/or the water heater 100. For example, the controller 205 includes, among other things, a processing unit 225 (e.g., a microprocessor, a microcontroller, or another suitable programmable device) and a memory 230. In some embodiments, the controller 205 is implemented partially or entirely on a printed circuit board or a semiconductor (e.g., a field-programmable gate array ["FPGA"] semiconductor) chip, such as a chip developed through a register transfer level ("RTL") design process.

In the illustrated embodiment, the controller 205 further includes a filter, or filtering module, 220. The filter 220 is configured to filter one or more sensed temperatures according to one or more algorithms and one or more time constants. In some embodiments, the filter 220 is implemented in whole or in part in software. In some embodiments, there is no separate module (e.g., filter 220), but rather any filtering is implemented using software stored on the memory 230 of the controller 205 and executed by the processing unit 225 of the controller 205.

The power supply 210 supplies power to the controller 205. In some embodiments, the power supply 210 receives an alternating-current (AC) power and converts the AC power into a nominal direct-current (DC) power. In other embodiments, the power supply 210 is a battery, or other power storage device. In yet other embodiments, the power supply 210 includes a thermopile configured to convert heat to energy. In such an embodiment, the thermopile may receive heat from the pilot burner 185 and/or the main burner 155. Additionally, in such an embodiment, the power supply 210 may include a power storage device to receive and store power from the thermopile.

The input/output module (I/O) module 215 provides a communication link between controller 205 and various components of the water heater 100, such as but not limited to, the gas valve assembly 130 and one or more temperature sensors 240. In some embodiments, the I/O module 215 further provides a communication link between controller 205 and external devices (for example, an external computer, a laptop, a tablet, a smartphone, etc.). The communication links may be wired and/or wireless. In some embodiments, the wireless communication link may be, but are not limited to, a radio frequency (RF) communications link, a Bluetooth communications link, and a WiFi communications link. Additionally, in some embodiments, the wireless communication link may be part of a local area network (LAN), a neighborhood area network (NAN), a home area network (HAN), or personal area network (PAN). In yet another embodiment, the wireless communication link may be part of a wide area network (WAN) (e.g., the Internet, a TCP/IP based network, a cellular network, such as, for example, a Global System for Mobile Communications [GSM] network, a General Packet Radio Service [GPRS] network, a Code Division Multiple Access [CDMA] network, an Evolution-Data Optimized [EV-DO] network, an Enhanced Data Rates for GSM Evolution [EDGE] network, a 3GSM network, a 4GSM network, a Digital Enhanced Cordless Telecommunications [DECT] network, a Digital AMPS [IS-136/TDMA] network, or an Integrated Digital Enhanced Network [iDEN] network, etc.).

In some embodiment, the gas valve assembly 130 may further include a gas valve, or main gas valve, 245 and a pilot gas valve 250. Gas valves 245, 250 are electronically controlled gas valves of the gas valve assembly 130 configured to control the flow of fuel. In some embodiments the gas valves 245, 250 are biased in a closed position. In such an embodiment, the gas valves 245, 250 open, and thus permit the flow of fuel, when a control signal is received from the controller 205. In some embodiments, the main gas valve 245 is configured to control the flow of fuel to the main gas burner 155, while the pilot gas valve 250 is configured to control the flow of fuel to the pilot burner 185.

The temperature sensors 240 sense one or more temperatures of the water heater 100. For example, a temperature sensor 240 may be used to sense a temperature of the fluid within the water tank 105 (for example temperature sensor 145), external and/or internal temperature of the inlet tube 110, external and/or internal temperature of the outlet tube 115, external and/or internal temperature of the flue 120, and/or external and/or internal temperature of the gas valve 245 (for example, inside the gas valve 245 or proximate the gas valve 245). In some embodiments, the temperature sensors 240 are electric temperature sensors, such as but not limited to thermistors, thermocouples, negative temperature coefficient (NTC) thermistors, resistance temperature detectors (RTDs), semiconductor-based sensors, and/or optical temperature sensors.

Figure 4:
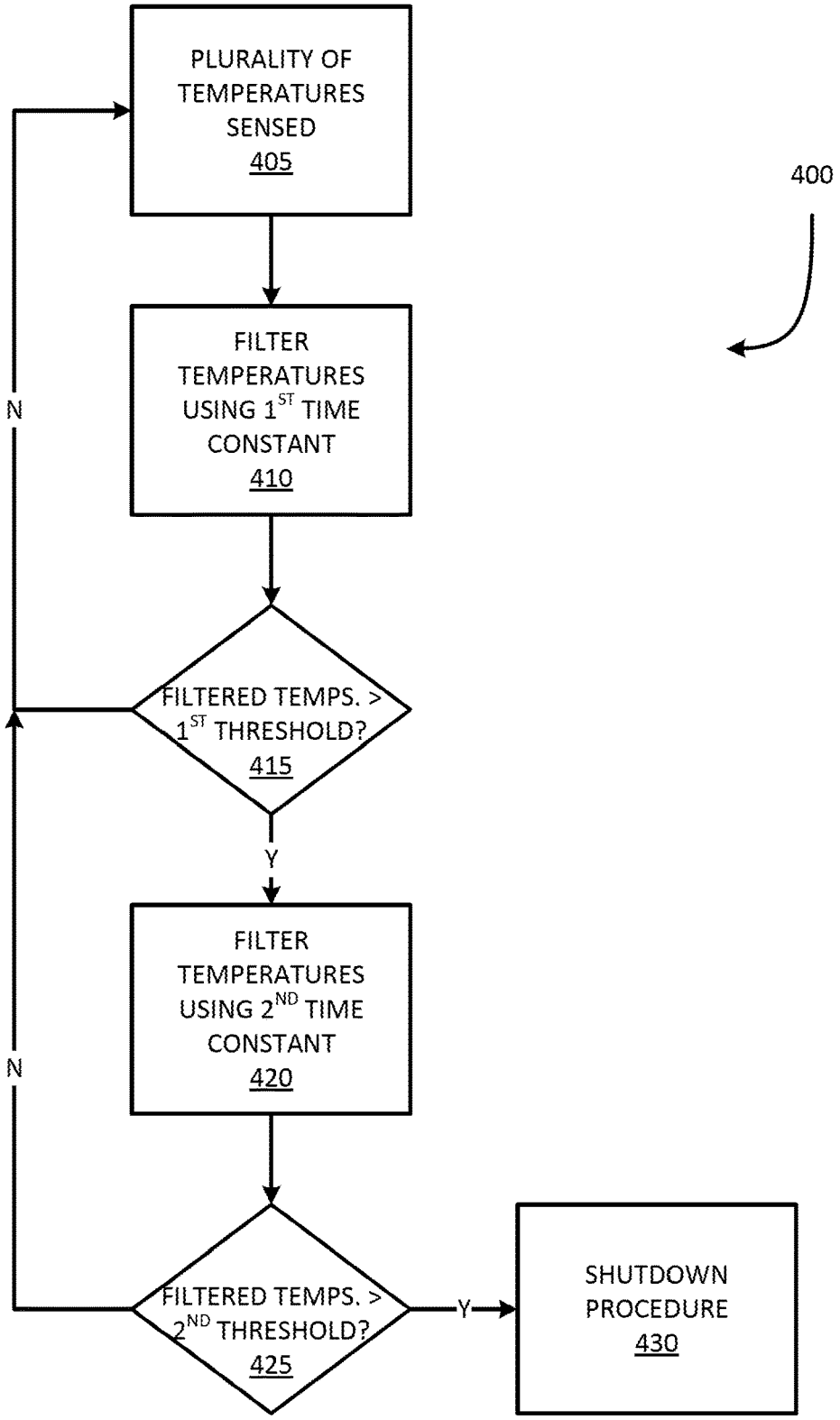
FIG. 4 is a method, or operation, of the of the water heater of FIG. 1 according to some embodiments of the application.

FIG. 4 illustrates a flow chart, or operation 400, of the control system 200. It should be understood that the order of the steps disclosed in operation 600 could vary. Additional steps may also be added to the control sequence and not all of the steps may be required. A plurality of temperatures is sensed by the temperature sensor 240 (block 405). The filtering module 220 filters the plurality of sensed temperatures using a first time constant (block 410). In some embodiments, the first time constant is between approximately 470 s and approximately 490 s (for example, approximately 480 s). In other embodiments, the first time constant is between approximately 300 s and approximately 340 s (for example, approximately 320). In some embodiments, the filtering module 220 filters the plurality of sensed temperature using the first time constant when at least one of the plurality of temperature crosses a temperature threshold.

The controller 205 then determines if at least one temperature of the plurality of filtered temperatures crosses a temperature threshold (block 415). In some embodiments, the temperature threshold is between approximately 180° F. and approximately 185° F. (for example, approximately 182° F.). If at least one temperature of the filtered temperatures does not cross the temperature threshold, operation 400 may cycle back to block 405.

If at least one temperature of the filtered temperatures crosses the temperature threshold, the filtering module 220 filters the plurality of sensed temperatures using a second time constant (block 420). In some embodiments, the second time constant is between approximately 150 s and approximately 170 s (for example, approximately 160 s). In other embodiments, the second time constant is between approximately 1500 s and approximately 1700 s (for example, approximately 1600 s). In yet other embodiments, the second time constant is between approximately 2000 s and approximately 2200 s (for example, approximately 2100 s). The controller 205 then determines if at least one temperature of the second plurality of filtered temperatures crosses a temperature threshold (block 425). In some embodiments, the temperature threshold is between approximately 185° F. and approximately 195° F. (for example, approximately 188° F.). If at least one temperature of the second plurality of filtered temperatures does not cross the temperature threshold, operation 400 may cycle back to 405. If at least one temperature of the second plurality of filtered temperatures crosses the temperature threshold, the controller 205 initiates a shutdown procedure (block 430). In some embodiments, the shutdown procedure includes shutting the gas valve 245. In some embodiments, the shutdown procedure includes outputting an indication (for example, to an external device via I/O module 215).

Figure 5:
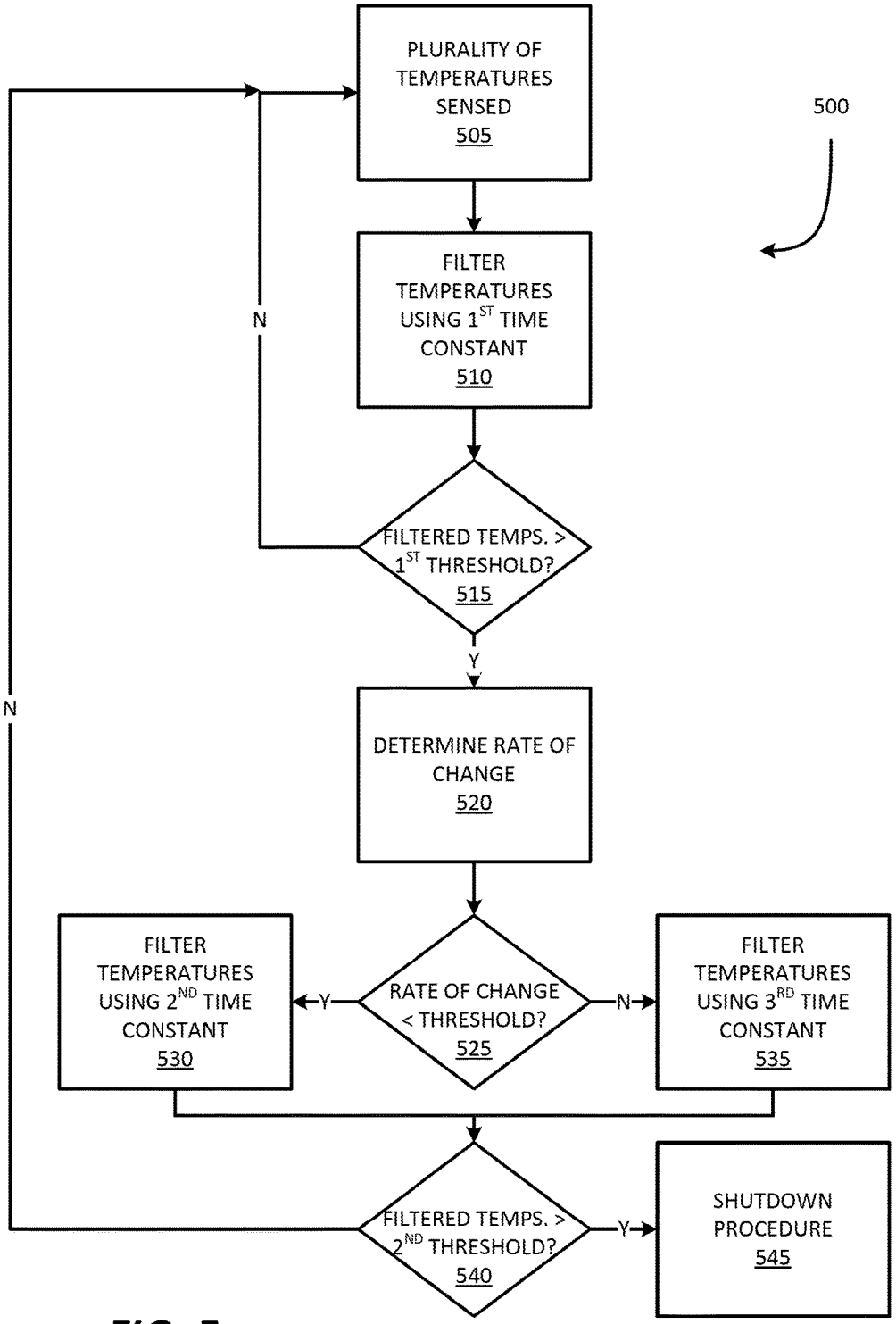
FIG. 5 is a method, or operation, of the of the water heater of FIG. 1 according to some embodiments of the application.

FIG. 5 illustrates another flow chart, or operation 500, of the control system 200. It should be understood that the order of the steps disclosed in operation 500 could vary. Additional steps may also be added to the control sequence and not all of the steps may be required. A plurality of temperatures are sensed by the temperature sensor 240 (block 505). The filtering module 220 filters the plurality of sensed temperatures using a first time constant (block 510). In some embodiments, the first time constant is between approximately 470 s and approximately 490 s (for example, approximately 480 s). In other embodiments, the first time constant is between approximately 310 s and approximately 330 s (for example, approximately 340 s). In some embodiments, the filtering module 220 filters the plurality of sensed temperature using the first time constant when at least one of the plurality of temperature crosses a temperature threshold.

The controller 205 determines if at least one temperature of the plurality of filtered temperatures crosses a temperature threshold (block 515). In some embodiments, the temperature threshold is between approximately 180° F. and approximately 185° F. (for example, approximately 182° F.). If at least one temperature of the filtered temperatures does not cross the temperature threshold, operation 500 may cycle back to block 505.

If at least one temperature of the filtered temperatures crosses the temperature threshold, the controller 205 determines a rate of change of a first temperature and a second temperature over a predetermined time period (bock 520). Controller 205 determines if the rate of change is less than a rate of change threshold (block 525). In some embodiments, the rate of change threshold is between approximately 0.2° F. per minute to approximately 0.5° F. per minute (for example, approximately 0.4° F. per minute). If the rate of change is less than the rate of change threshold, filtering module 220 filters the plurality of sensed temperatures using a second time constant (block 530). In some embodiments, the second time constant is between approximately 150 s and approximately 170 s (for example, approximately 160 s). In other embodiments, the second time constant is between approximately 2000 s and approximately 2200 s (for example, approximately 2100 s). If the rate of change is greater than the rate of change threshold, filtering module 220 filters the plurality of sensed temperatures using a third time constant (block 535). In some embodiments, the third time constant is between approximately 300 s and approximately 340 s (for example, approximately 320 s).

In some embodiments, the rate of change threshold is approximately zero. In such an embodiment, the controller 205 determines if the rate of change of the first temperature and the second temperature is increasing or decreasing. If the rate of change is decreasing, filtering module 220 filters the plurality of sensed temperatures using the second time constant. If the rate of change is increasing, filtering module 220 filters the plurality of sensed temperatures using the third time constant.

The controller 205 then determines if at least one temperature of the second plurality of filtered temperatures (for example, filtered using the second time constant or the third time constant) crosses a temperature threshold (block 540). In some embodiments, the temperature threshold is between approximately 185° F. and approximately 195° F. (for example, approximately 188° F.). If at least one temperature of the second plurality of filtered temperatures does not cross the second temperature threshold, operation 500 may cycle back to 505. If at least one temperature of the second plurality of filtered temperatures crosses the temperature threshold, the controller 205 initiates a shutdown procedure (block 545). In some embodiments, the shutdown procedure includes shutting the gas valve 245. In some embodiments, the shutdown procedure includes outputting an indication (for example, to an external device via I/O module 215).

Figure 6:
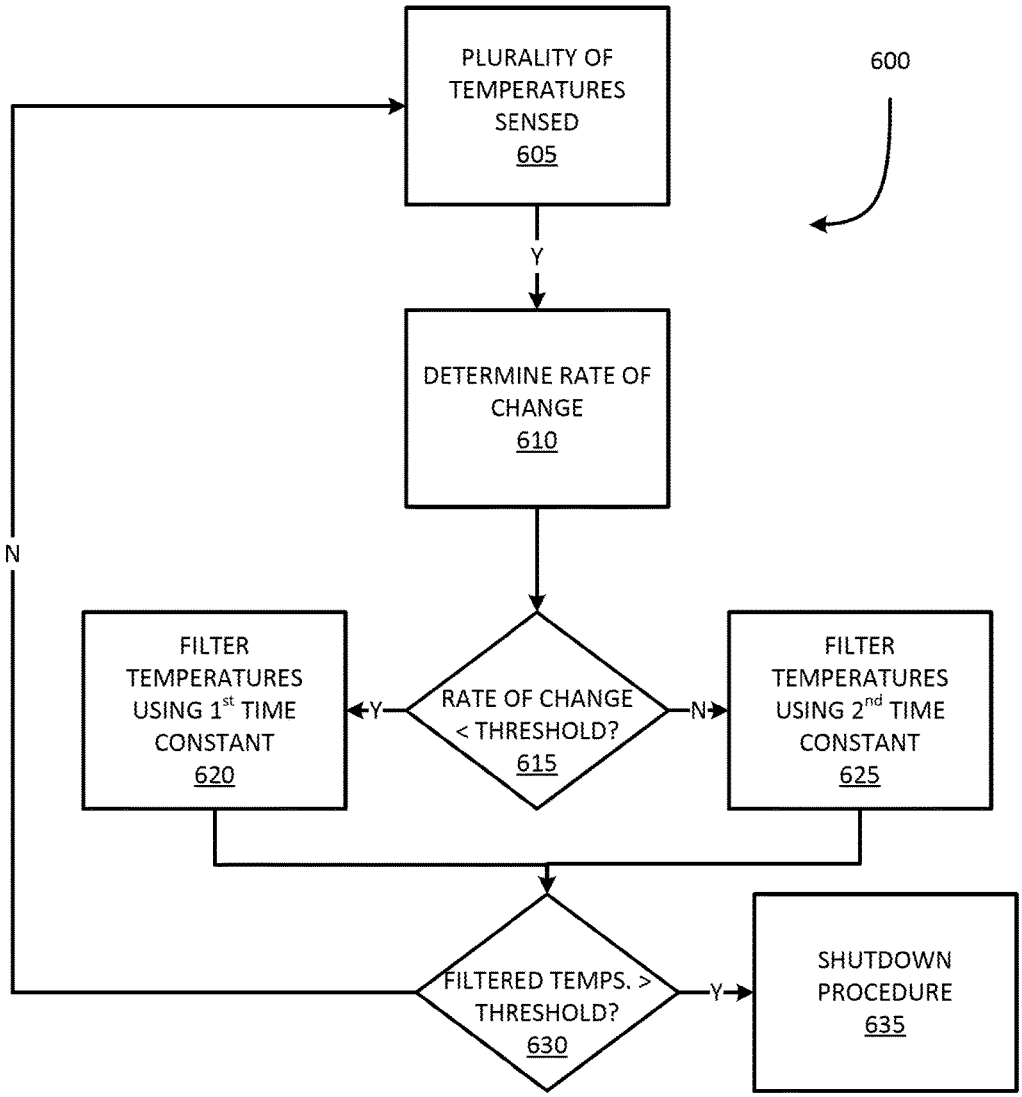
FIG. 6 is a method, or operation, of the of the water heater of FIG. 1 according to some embodiments of the application.

FIG. 6 illustrates another flow chart, or operation 600, of the control system 200. It should be understood that the order of the steps disclosed in operation 600 could vary. Additional steps may also be added to the control sequence and not all of the steps may be required. A plurality of temperatures is sensed by the temperature sensor 240 (block 605). The controller 205 determines a rate of change of a first temperature and a second temperature over a predetermined time period (bock 610). Controller 205 determines if the rate of change is less than a rate of change threshold (block 615). In some embodiments, the rate of change threshold is between approximately 0.2° F. per minute to approximately 0.5° F. per minute (for example, approximately 0.4° F. per minute). If the rate of change is less than the rate of change threshold, filtering module 220 filters the plurality of sensed temperatures using a first time constant (block 620). In some embodiments, the second time constant is between approximately 310 s and approximately 330 s (for example, approximately 320 s). In other embodiments, the first time constant is between approximately 400 s and approximately 440 s (for example, approximately 320). If the rate of change has crossed the rate of change threshold, filtering module 220 filters the plurality of sensed temperatures using a second time constant (block 625). In some embodiments, the second time constant is between approximately 1550 s and approximately 1650 s (for example, approximately 1600 s). In other embodiments, the second time constant is between approximately 2000 s and approximately 2200 s (for example, approximately 2100 s). In yet other embodiments, the second time constant is between approximately 150 s and approximately 170 s (for example, approximately 160 s).

The controller 205 then determines if at least one temperature of the plurality of filtered temperatures crosses a temperature threshold (block 630). In some embodiments, the temperature threshold is between approximately 185° F.

and approximately 195° F. (for example, approximately 188° F.). If at least one temperature of the plurality of filtered temperatures does not cross the temperature threshold, operation 500 cycles back to 505. If at least one temperature of the plurality of filtered temperatures crosses the temperature threshold, the controller 205 initiates a shutdown procedure (block 635). In some embodiments, the shutdown procedure includes shutting the gas valve 245. In some embodiments, the shutdown procedure includes outputting an indication (for example, to an external device via I/O module 215).

In some embodiments, the rate of change threshold is approximately zero. In such an embodiment, the controller 205 determines if the rate of change of the first temperature and the second temperature is increasing or decreasing. If the rate of change is decreasing, filtering module 220 filters the plurality of sensed temperatures using the first time constant. If the rate of change is increasing, filtering module 220 filters the plurality of sensed temperatures using the second time constant.

During normal operation, the main gas valve 245 is selectively opened and closed to control the flow of fuel to the main burner 155. In some embodiments, operations 400, 500, 600 may be used to detect when the main gas valve 245 fails to close (for example, an abnormal condition may result from failure of the main gas valve 245 from closing). In such an embodiment, the shutdown procedure includes closing a backup valve. In some embodiments, the backup valve is the pilot gas valve 250.

Thus, the application provides, among other things, a system and method for detecting abnormal conditions of a water heater. Various features and advantages of the application are set forth in the following claims.

What is claimed is:

1. A method of determining an abnormal condition in a water heater, the method comprising:

sensing, via a temperature sensor, a plurality of temperatures;

filtering, using a first time constant, the plurality of sensed temperatures to produce a first plurality of filtered temperatures;

determining, via a controller, if at least one temperature of the first plurality of filtered temperatures crosses a first temperature threshold;

when at least one temperature of the first plurality of filtered temperatures crosses the first temperature threshold, filtering, using a second time constant, the plurality of sensed temperatures to produce a second plurality of filtered temperatures; and initiating, via the controller, a shutdown procedure when at least one temperature of the second plurality of filtered temperatures, crosses a second temperature threshold.

2. The method of claim 1, wherein the plurality of sensed temperatures are filtered, using the first time constant, when at least one temperature of the plurality of temperatures is above a third temperature threshold.

3. The method of claim 1, further comprising:

determining, via the controller, a rate of change based on a first temperature and a second temperature of the plurality of sensed temperatures over a predetermined time period.

4. The method of claim 3, further comprising:

determining, via the controller, if the rate of change is below a threshold; and filtering, using a third time constant, the plurality of sensed temperatures to produce a third plurality of filtered temperatures when the at least one temperature of the first plurality of filtered temperatures crosses the first temperature threshold and the rate of change is below the threshold.

5. The method of claim 4, wherein the threshold is approximately 0.4° F. per minute.

6. The method of claim 4, wherein the third time constant is approximately 1600 second.

7. The method of claim 1, wherein the first temperature threshold is approximately 182° F.

8. The method of claim 1, wherein the second temperature threshold is approximately 188° F.

9. The method of claim 1, wherein the shutdown procedure includes shutting a gas valve.

10. The method of claim 1, wherein the plurality of sensed temperatures is a plurality of gas valve temperatures.

11. The method of claim 1, wherein the first time constant is at least one selected from the group consisting of approximately 480 seconds and approximately 320 seconds.

12. The method of claim 1, wherein the second time constant is at least one selected from the group consisting of approximately 160 seconds, approximately 1600 seconds, and approximately 2100 seconds.

13. A method of determining an abnormal condition in a water heater, the method comprising:

sensing, via a temperature sensor, a plurality of temperatures;

filtering, using a first time constant, the plurality of sensed temperatures to produce a first plurality of filtered temperatures;

determining, via the controller, a rate of change based on a first temperature and a second temperature of the plurality of sensed temperatures over a predetermined time period;

determining, via the controller, if the rate of change is below a threshold;

when the rate of change is below the threshold, filtering, using a second time constant, the plurality of sensed temperatures to produce a second plurality of filtered temperatures; and initiating, via the controller, a shutdown procedure when at least one temperature of the second plurality of filtered temperatures, crosses a temperature threshold.

14. The method of claim 13, further comprising:

when the rate of change is above the threshold, filtering, using a third time constant, the plurality of sensed temperatures to produce a third plurality of filtered temperatures.

15. The method of claim 14, further comprising:

initiating, via the controller, a shutdown procedure when at least one temperature of the third plurality of filtered temperatures, crosses the temperature threshold.

16. The method of claim 14, wherein the third time constant is approximately 160 seconds.

17. The method of claim 13, wherein the plurality of sensed temperatures are filtered, using the first time constant, when at least one temperature of the plurality of sensed temperatures is above a second temperature threshold.

18. The method of claim 13, wherein the threshold is approximately 0.4° F. per minute.

19. The method of claim 13, wherein the first temperature threshold is approximately 182° F.

20. The method of claim 13, wherein the second temperature threshold is approximately 188° F.

21. The method of claim 13, wherein the shutdown procedure includes shutting a gas valve.

22. The method of claim 13, wherein the plurality of sensed temperatures is a plurality of gas valve temperatures.

23. The method of claim 13, wherein the first time constant is at least one selected from the group consisting of approximately 480 seconds and approximately 320 seconds.

24. The method of claim 13, wherein the second time constant is at least one selected from the group consisting of approximately 160 seconds, approximately 1600 seconds, and approximately 2100 seconds.

* * * * *